United States Patent [19]

Ostrowsky

[11] Patent Number: 4,487,324

[45] Date of Patent: Dec. 11, 1984

[54] TAMPER-EVIDENT DISPENSING CLOSURE

[75] Inventor: Efrem M. Ostrowsky, Highland Park, Ill.

[73] Assignee: Seaquist Closures, a Division of Pittway Corporation, Crystal Lake, Ill.

[21] Appl. No.: 578,026

[22] Filed: Feb. 8, 1984

[51] Int. Cl.[3] ..... B65D 55/02

[52] U.S. Cl. ..... 215/253; 215/225; 215/235

[58] Field of Search ..... 215/253, 201, 204, 225, 215/235, 250, 253, 254, 255, 256, 356; 220/254, 268, 269

[56] References Cited

U.S. PATENT DOCUMENTS

| | | | |
|---|---|---|---|
| 2,913,134 | 11/1959 | Randlett | 215/225 |
| 2,950,834 | 8/1960 | Mazza | 215/254 |
| 3,441,161 | 4/1969 | Van Baarn | 215/235 |
| 3,877,598 | 4/1975 | Hazard | 215/250 X |
| 4,220,248 | 9/1980 | Wilson et al. | 215/235 |
| 4,377,247 | 3/1983 | Hazard et al. | 215/235 X |

*Primary Examiner*—Steven M. Pollard

*Attorney, Agent, or Firm*—Dressler, Goldsmith, Shore, Sutker & Milnamow, Ltd.

[57] ABSTRACT

A dispensing package having a tamper-evident dispensing closure. A tamper-indicating removable strip is integrally formed with the closure and is secured to one of the closure body and closure cover via frangible bridging means. The closure hingedly connects the cover and body. The body defines a dispensing orifice and the cover seals the orifice. The strip defines spaces and the other one of the body and cover defines projections which extend into the spaces to resist relative movement of the body and cover unless the frangible bridging means are severed and thereby shows that access has been gained to the dispensing orifice. The closure is preferably generally circular and the tamper-indicating means are preferably within the perimeter of the closure.

20 Claims, 7 Drawing Figures

FIG. 1
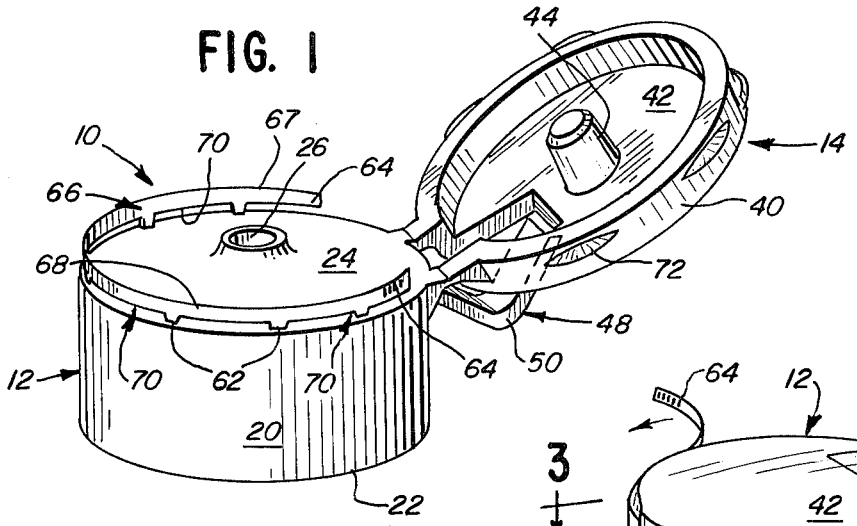
FIG. 2
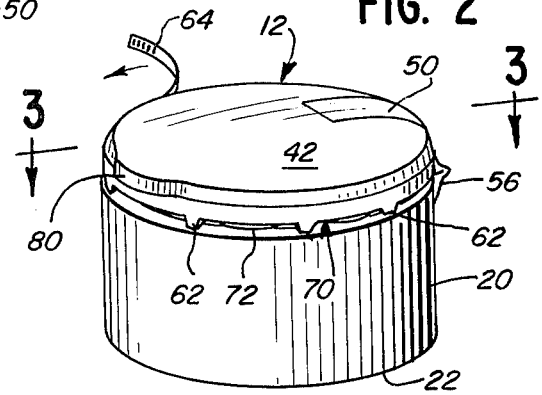
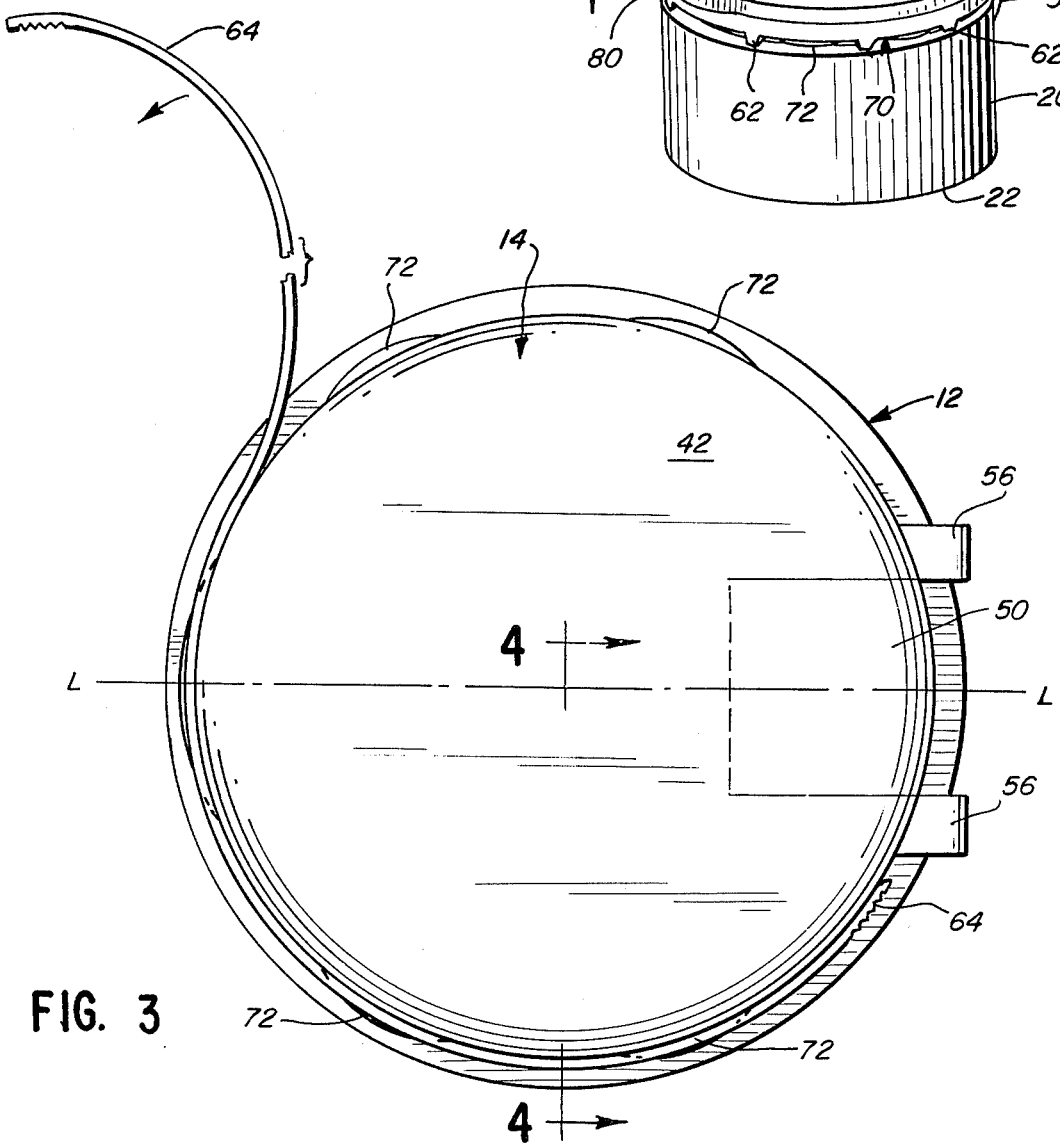
FIG. 3

TAMPER-EVIDENT DISPENSING CLOSURE

BACKGROUND OF THE INVENTION

This invention relates to tamper-evident dispensing closures.

In very recent years, it has become increasingly important to protect the contents of packaging from the casual prospective purchaser as well as from those who occasionally deliberately seek to tamper with the contents of a container.

Dispensing closures, such as those which have been made in accordance with U.S. Pat. Nos. 3,289,877 and RE-30,851, and other types of over-center, and other hinged dispensing closures have been widely used and to great advantage by the consumer. However, they are not tamper-evident and therefore require a supplemental seal or the like if the package is to be made tamper-evident.

It would be of substantial advantage if such closures were to be made tamper-evident, and particularly if the tamper-evident character of the closure did not alter the aesthetics or the operational structure of the dispensing closure.

SUMMARY OF THE INVENTION

In accordance with the present invention, dispensing closures of the types made in accordance with U.S. Pat. Nos. 3,289,877, RE-30,851 and others, may be made tamper-evident without altering the aesthetics or operational characteristics of the closures. To this end, the present invention relates to a closure, which may preferably be made of thermoplastic material, the closure comprising a body adapted to be secured to a container and a cover connected to a body for movement between closed and open positions. Preferably the closure is adapted to be secured to a container via means for resisting removal of the closure from the container, which means may comprise a snap-connecting, removal-resistant means. The cover and body are connected, desireably via a hinge connection and preferably via an over-center hinge. The body defines a dispensing orifice and the cover provides means for sealing the orifice when the cover is in a closed position.

The dispensing closure is formed with tamper-indicating means for making evident the fact that access has been gained to the dispensing orifice when such has occurred. The tamper-indicating means desirably comprises a removable strip integrally formed with the closure and connected via frangible bridging means, such as plurality of frangible bridges to one of said body and cover, and desirably to the body. The removable strip defines recess means. Projection means are formed with the other one of the body and cover and extend into the recess means. As such, when one attempts to move the cover from the closed position towards an open position, the projection means bear against the removable strip which prevents the cover from readily moving from the closed position towards the open position without first severing at least a portion of the frangible bridging means, such as by severing at least one or more of the plurality of frangible bridges. The proportioning is such that unless the frangible bridging means is severed, access may not be gained to the dispensing orifice, so that when a prospective purchaser looks at the package with which the tamper-evident dispensing closure has been associated, he may be reasonably assured, if the frangible means (such as all of the frangible bridges) are intact, that the closure has not been tampered with and access has not been gained to the dispensing orifice.

In a presently preferred embodiment there are at least two recess means or spaces and at least two projection means, and the closure is generally circular with the projection means and recess means being each spaced apart at least about 30° from each other. Desirably the recess means are defined by the removable strip, and by the frangible means, and by one of the body and cover.

The tamper-indicating means and the removable strip may be disposed within the perimeter of the closure and desirably has no protuberance extending outwardly of the perimeter of the closure.

Further objects, features and advantages of the present invention will become apparent from the following description and drawings.

BRIEF DESCRIPTION OF THE DRAWINGS

FIG. 1 is a perspective view of a tamper-evident dispensing closure of this invention prior to being closed to assume its tamper-evident condition;

FIG. 2 is the tamper-evident dispensing closure of FIG. 1 in its closed, tamper-evident condition, with an associated tear strip partially moved into an unsealing condition;

FIG. 3 is a plan view of the closure of FIG. 2;

DESCRIPTION OF THE PREFERRED EMBODIMENTS

Figure 4:
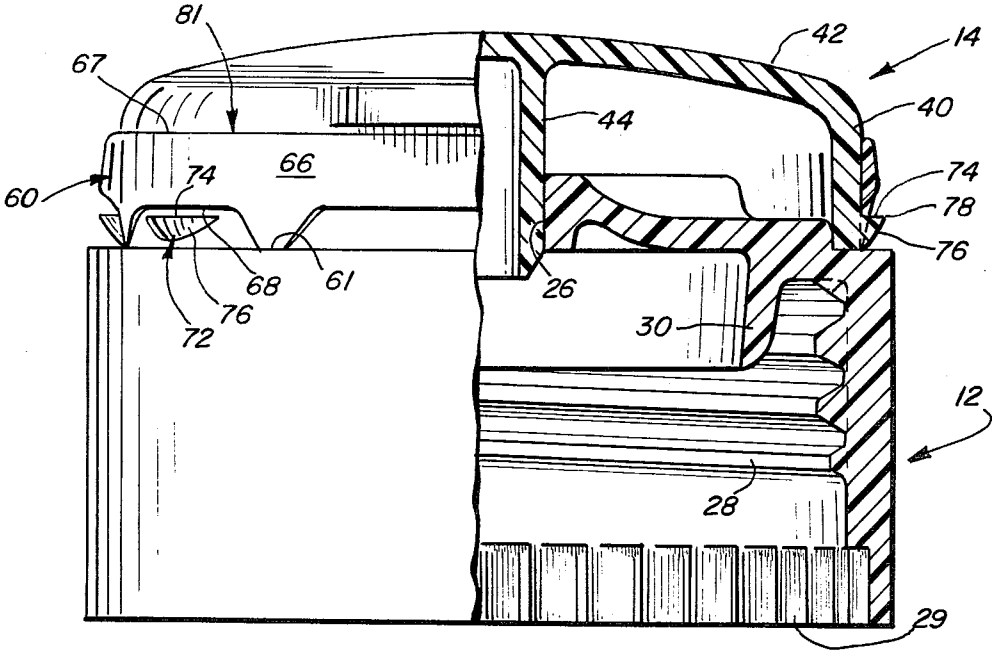
FIG. 4 is a view partially in cross-section taken substantially along line 4—4 of FIG. 3.

Referring now to the drawings, and particularly to FIGS. 1–6, a tamper-evident dispensing closure 10 of this invention comprises a body portion 12 and a cover portion 14. The closure is generally circular in plan view.

The body portion 12 comprises a generally cylindrical skirt 20 which is open at its lower end 22 and which is generally closed, as by a deck 24, at its upper end. Deck 24 defines a suitable discharge orifice 26. In the embodiment disclosed, the skirt defines threads 28 which are adapted to be threadedly engaged with the threaded neck of a container C (FIG. 6), such as a squeezeable bottle. The closure 10 is adapted to be fixedly secured to the container so that it may not readily be removed therefrom. A suitable means for accomplishing this is to provide ratchet teeth 29 on the inside of the skirt, shaped and proportioned to cooperate with lugs 31 on the neck of the container C (see FIG. 6). Once the closure is secured, the interlocking teeth make it impossible to unscrew the closure from the container. A typical suitable ratchet teeth-container lug configuration is shown and described in U.S. Pat. No. 4,345,691.

Figure 7:
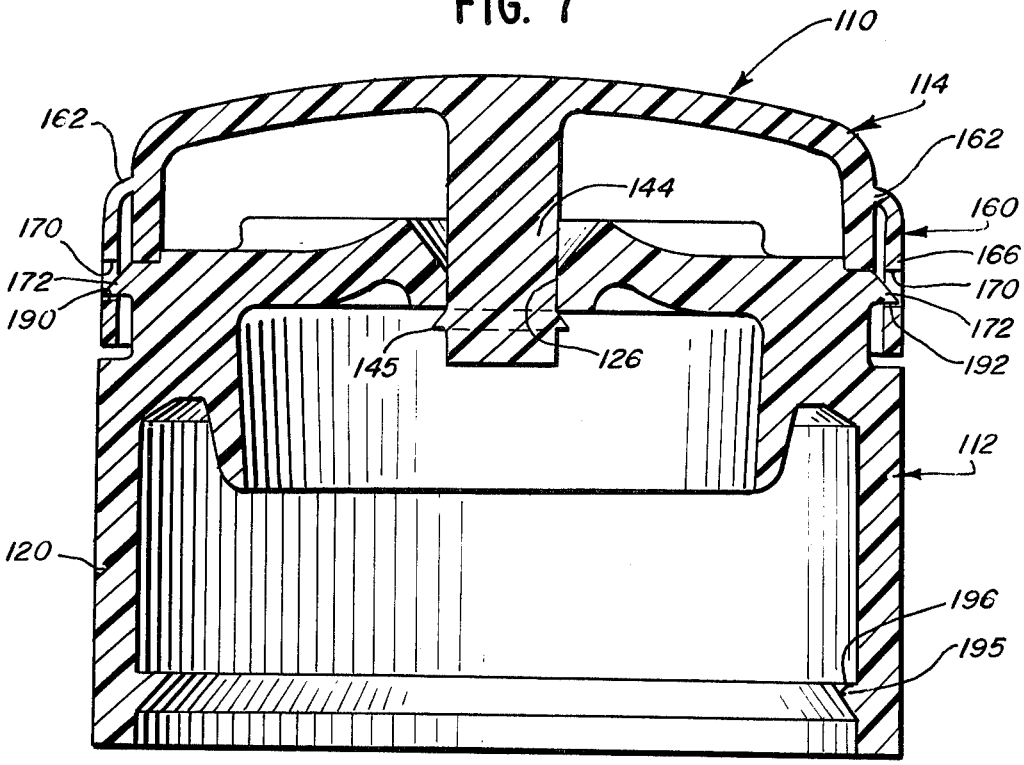
FIG. 7 illustrates a further embodiment of the tamper-evident dispensing closure of the present invention, in which a tear strip is shown as being formed with the closure cover rather than with the closure body.
Figure 6:
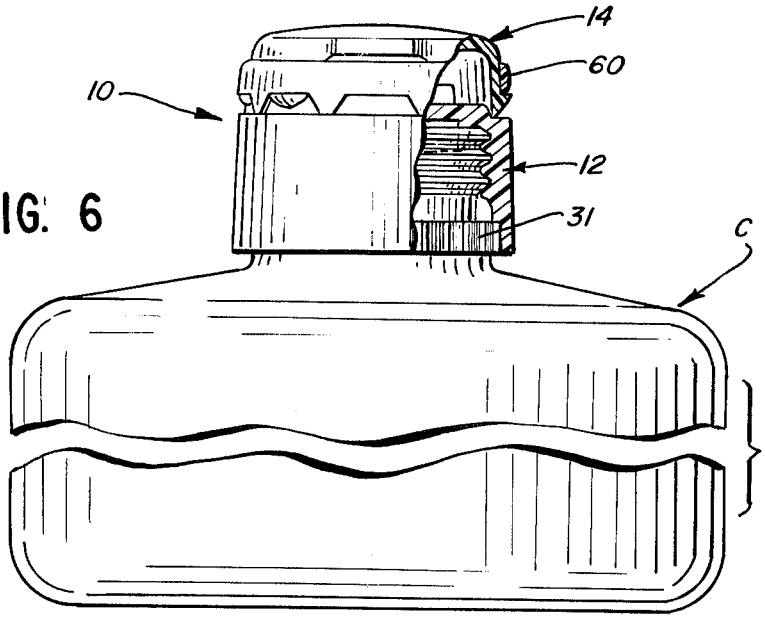
FIG. 6 is a package with which the tamper-evident dispensing closure of FIG. 1 has been associated.

A suitable gasket portion such as sleeve 30 (see FIG. 4) is adapted to cooperate with the neck of the container C to seal the container mouth or opening defined thereby when the threads 28 have been suitably screwed down to sealingly secure them to the threaded container neck. Other gasketing, such as an inserted gasket or the like, may be used depending upon the nature of the container to which the dispensing closure 10 is to be attached. Of course, a dispensing closure in which the body portion 12 is adapted to be snap-secured to the neck of a container, rather than threadingly secured, may be used as well, and this may sometimes be a preferred manner of fixedly securing the closure to the container so that it may not readily be removed therefrom. Such a closure is illustrated in FIG. 7 and will be described later. The use of a snap-securance arrangement also facilitates achieving controlled radial orientation of the closure and closure orifice with the bottle shape and/or the label.

The cover portion 14 comprises a cover skirt 40 which is closed at its upper end, as by a crown portion 42. The crown portion may define a sealing post or stud 44 which is proportioned to project into, and thereby sealingly engage, the discharge orifice 26 in a known manner, thereby to prevent discharge, leakage or evaporation of the contents of the container C when it is in an upright position, or an inverted position, or when it is squeezed, or during shipping and/or storage.

Typically, the body portion 12 and cover portion 14 are integrally formed of a suitable plastic material and are connected by a suitable hinge assembly. A variety of suitable thermoplastic materials for such purposes is known, including polypropylene. In the embodiments illustrated in FIGS. 1–7, the hinge assembly 48 includes a strap member 50 which is integrally connected to cover portion 14 via a cover hinge 52. At the end of the strap remote from the cover hinge 52, strap 50 is connected to the body by body hinge 54. The body and cover portions are additionally connected to each other at a location remote from the strap 50, namely via upper hinges 56.

Figure 5:
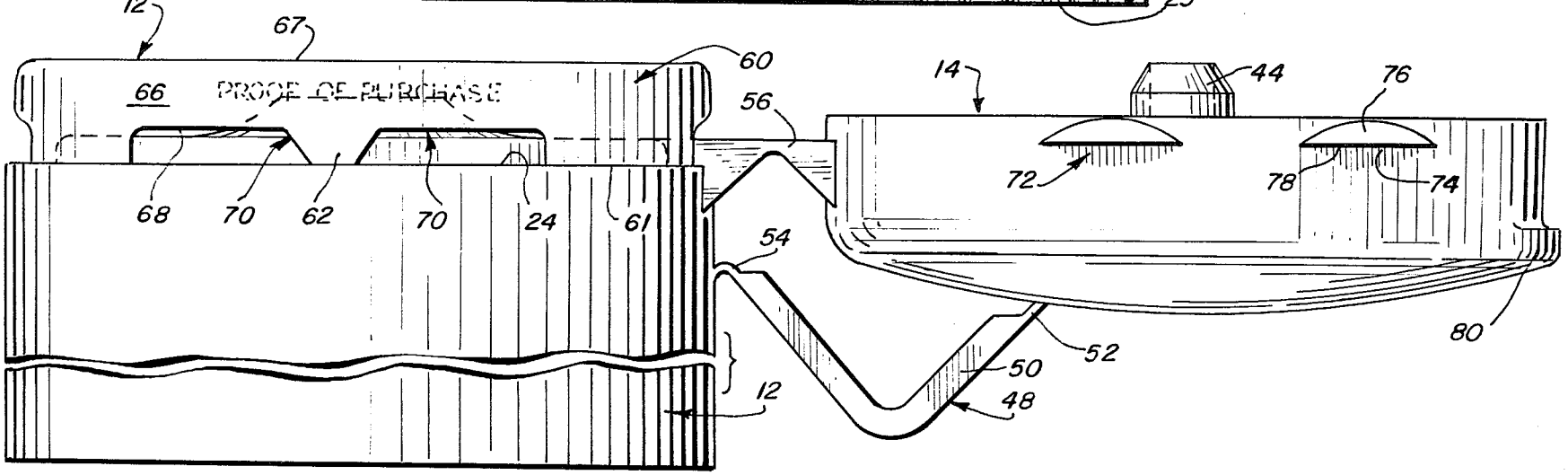
FIG. 5 is an enlarged view of the closure as shown in FIG. 4, opened and rotated 90 degrees.

As shown, hinge assembly 48 is a snap-type hinge which has an over-center action. Therefore, when the cover portion 14 is moved relative to the body portion 12 about the upper hinge 56 to the over-center position, the cover tends to be biased to one or the other of two extreme positions, one of which positions is generally illustrated in FIGS. 1 and 5 (the open position), and the other of which is generally illustrated in FIGS. 2 and 4 (the fully closed or nearly fully closed position). The fully-closed position illustrated in FIGS. 2 and 4 has required some additional further movement to bring the cover portion 14 into that fully closed relationship with the body portion 12, as is well-known in the art. Over-center types of hinge constructions used with dispensing closures are typically illustrated in U.S. Pat. Nos. 3,289,877 and RE 30,851. Although the over-center type of hinge construction is preferably to be used in conjunction with the present invention, the invention is obviously not so limited, and other types of hinge constructions may be used as well such as, for example, those shown in U.S. Pat. Nos. 3,991,904, 4,170,315, 4,010,875 and 4,377,247.

In one form of the present invention, the tamper-evident sealing arrangement of the dispensing part of the closure comprises a frangible removable element, such as a tear strip 60, which is integrally formed or molded with the body portion 12, via frangible bridging means comprising a thinned line of juncture 61 between the strip and the body portion. The frangible bridging means may comprise a plurality of frangible connecting bridges 62. Tear strip 60 is disposed essentially vertically, that is, generally parallel to the central axis of the closure and container, and is located within the outer circular perimeter of the closure body. This unique construction permits successful mechanical handling of the closure without damage to the tamper-evident system, while protecting the dispensing portion of the dispensing closure, especially during capping of a container after filling when the machine capping heads normally grip the outer surfaces of the closure.

An additional advantage of this one-piece, tamper-evident construction in which there are no external protuberances is its aesthetic appeal, especially for cosmetic packages and the like. Thus, a smooth external configuration may be provided.

In the embodiment illustrated there are six frangible connecting bridges 62, three of which are on each side of a center line, line L—L (FIG. 3), which extends from the front to the rear of the closure 10. The tear strip 60 terminates rearwardly in one or two gripper tabs 64 which are positioned and proportioned to be gripped between the thumb and finger of a user.

Tear strip 60 may be imprinted or molded with indicia thereon to provide a variety of messages, such as proof of purchase messages. When removed it may be used as a "proof-of-purchase" signifier, and, therefore, the present construction has that additional advantage.

In addition to the frangible connecting bridges 62, tear strip 60 comprises an upper band portion 66 which terminates rearwardly in the gripper tabs 64. It is from the band portion 66 that the frangible connecting bridges depend.

As seen in the drawings, the bridges 62 are spaced apart circumferentially. Recess means, such as spaces 70, are defined by the lower edges 68 of the band 66, side edges of the bridges 62, and the confronting portions of the deck 24. Thus, a plurality of spaces 70 are circumferentially spaced around at least a portion of the closure 10.

The cover portion 14 defines a plurality of integrally formed projections 72 which are circumferentially spaced around a portion of the closure 10 in positions corresponding to spaces 70. The projections 72 project in a direction outwardly of the cover and are proportioned to be received within the spaces 70 for a purpose to be described.

In the embodiment illustrated, there are four projections 72 (and corresponding spaces 70), two on each side of the center line. It is preferred that there be at least two projections, and if there are only two that they be on opposite sides of the center-line L—L and spaced from each other circumferentially more than about 30° to minimize the possibility that they might be manipulated to frustrate the tamper-evident purpose of the assembly.

Referring now to the projections 72 in more detail, it is apparent that each projection 72 defines an upper surface 74 which is preferably generally flat and which lies in a plane generally parallel to the deck 24. The lower surface 76 of each projection 72 is inclined generally upwardly and outwardly from the zone at which it is integrally formed with the cover portion 14. The circumferential extent of the projections 72 is equal to or preferably somewhat less than the circumferential extent of the spaces 70 so that the projections 72 may readily be received and disposed within the spaces 70.

When the dispensing closure 10 of this invention is formed, as by molding, it is usually molded in a position typified by FIG. 5. Either in the mold, or after the closure has been removed from the mold, the cover portion 14 is pivotally moved about the hinge assembly 48 from the positions of FIG. 5, through the position of FIG. 1, to the fully-closed position of FIG. 2. In so doing, the lower surfaces 76 of the projections 72 are brought into contact with the upper surfaces of the tear strip 60, namely the upper edge 67 of the band 66. The inclined surfaces 76 of the projections, and then the outer edges 78 of the projections bear against the band edge 67 and are cammed and slide downwardly against the inner surface of the band until the projections 72 reach the elevation of the spaces 70. At that point, the projections then snap and extend into the spaces 70, with the upper surfaces 74 closely confronting the lower surfaces 68 of the band 66. At that time, it becomes practically impossible to lift the cover portion 14 relative to the body portion 12 without severing at least one or more of the connections between the frangible bridges and the body portion 12 because the projections lie under the band 66.

If an effort has been made to lift the cover portion 14 relative to the body portion 12 and, as a result, one or more of the frangible bridges has therefore been severed from its connection with the body portion, that will make evident the fact that access to the container C through the discharge orifice 26 may have been gained.

When one purchases a container to which the tamper-evident dispensing closure 10 has been affixed, one may check to see if any of the frangible bridges has been severed. If such has occurred, one should return the container. If such has not occurred, one may then assume access to the orifice has not been gained. To gain access to the container contents, one grips a gripper tab 64, and the thinned or frangible line of juncture connection between the frangible connecting bridges 62 and the body portion 14 is then severed by pulling the gripper tab. At that point, the cover portion 14 may be freely swung upwardly, as about the upper hinge 56, and the dispensing closure may thereafter be used in the same manner in which like dispensing closures are currently used. To facilitate movement of the cover portion about the hinge 56, a conventional lift tab 80 may be provided on the cover portion 14.

It will be apparent that the projections on the cover portion and the tear strip with the frangible connecting tabs on the body portion, may be reversed. That is to say that the frangible tear strip may be integrally formed with the cover portion. FIG. 7 illustrates such an alternative embodiment. As pointed out above, it is also apparent that dispensing closures having hinged connections other than the particular hinge arrangement described in connection with the specific embodiment may be used. As such, the hinge arrangement need not necessarily be one of the over-center type.

Referring now to FIG. 7, the tamper-evident dispensing closure 110 there shown includes a body portion 112, a cover portion 114 and a body skirt 120. The cover portion 114 mounts a stud 144 which includes a retaining barb 145 to assist in sealing the discharge orifice 126.

The cover portion is hingedly secured to body portion 112 by a hinge mechanism just like that of the embodiment of FIGS. 1–6. In the embodiment of FIG. 7, a tear strip 160 is secured to the cover portion by a frangible bridging means, such as by a plurality of frangible connecting bridges 162. Gripper tabs (not shown) like those of FIG. 1–6 are provided for removal of the tear strip. The tear strip includes a band portion 166. The band portion 166 defines a plurality of spaces 170, the circumferential extent of which is generally slightly greater than the circumferential extent of projections 172 which are formed with the body portion 112. Spaces 170 are defined in part by a generally lower edge 190 which confronts an edge 192 of projection 172.

As is apparent, any effort to lift cover portion 114 will cause edges 190 and 192 to bear strongly against each other, stressing the frangible bridges 162. Unless bridges 162 are then severed, the cover may not be elevated. If one or more of the bridges are severed, it will then be evident that the package has been tampered with. The nature of the materials used, the proportioning of the parts, and the number and location of the spaces 170 and projections 172 all may be varied appropriately to insure that it is either impossible or virtually so, so to manipulate the band that access may be gained to the orifice without breaking one or more of the frangible bridges.

The embodiment of FIG. 7 also illustrates a snap-connecting type of closure as distinguished from a screw-on closure. It is understood that this snap-connecting system may also be used on the embodiments illustrated in FIGS. 1 through 6. To this end the connecting means comprises an internal bead 195, preferably having a shelf-like upper edge 196. The closure 110 is adapted to be snap-connected to a bottle or other container having a complementary neck configuration, and defining either a recess in the neck or a projection on the neck over which the bead is adapted to be forced downwardly so that the upper edge 196 then confronts a complementary edge to resist removal of the closure from the container neck in a known manner. As stated above, this manner of securing the closure to a package facilitates close radial control over the radial orientation of the closure and orifice, more so than screw-on closures permit.

From the foregoing, it will be apparent to those skilled in the art that further modifications may be made and provided without departing from the spirit of the invention. Accordingly, the scope of the invention is to be considered to be limited only to the extent made necessary by the claims.

What is claimed is:

1. A tamper-evident dispensing closure comprising a body adaptable to be secured to a container, a cover hingedly connected to said body for movement between open and closed positions and means for hingedly connecting said cover and said body, a dispensing orifice defined by said body and means on said cover for sealing said orifice when said cover is in a closed position, tamper-indicating means formed with said dispensing closure for making evident that access has been gained to said dispensing orifice, said tamper-indicating means comprising a removable strip integrally formed with the closure and connected via frangible bridging means to one of said body and cover, said removable strip defining recess means, and projection means formed with the other of said body and cover, and said projection means extending into said recess means, whereby when said cover is moved from said closed position towards an open position, said projection means bear against said removable strip and the cover may not readily be moved from said closed position without first severing at least a portion of said frangible bridging means.

2. A tamper-evident dispensing closure in accordance with claim 1 in which said frangible bridging means comprises a plurality of discrete frangible bridges connected to one of said body and said cover, and wherein said cover may not be readily moved from said closed position without first severing at least one of said bridges.

3. A tamper-evident dispensing closure in accordance with claim 2 wherein said plurality of frangible bridges are connected to said body and are integrally formed therewith.

4. A tamper-evident dispensing closure in accordance with claim 2 wherein said recess means are at least two in number and said projection means are at least two in number.

5. A tamper-evident dispensing closure in accordance with claim 4 in which said projection means are formed with said cover and project in a direction outwardly of said cover.

6. A tamper-evident dispensing closure in accordance with claim 2 wherein said recess means are defined by said removable strip, by said frangible means and by one of said body and cover.

7. A tamper-evident dispensing closure in accordance with claim 6 wherein said removable strip is connected to said body.

8. A tamper-evident dispensing closure in accordance with claim 1 wherein said dispensing closure is generally circular and said projection means and said recess means are each spaced apart at least about 30° from each other.

9. A tamper-evident dispensing closure in accordance with claim 1 wherein said recess means are defined by said removable strip.

10. A tamper-evident dispensing closure in accordance with claim 1 wherein means for hingedly securing said cover and said body comprises an over-center, snap-type hinge.

11. A tamper-evident dispensing closure in accordance with claim 1 wherein said tamper-indicating means and said removable strip are disposed within the perimeter of the closure and have no protuberance extending outwardly of the perimeter of the closure.

12. A tamper-evident dispensing closure in accordance with claim 1 wherein said closure defines means for securing the closure to a container, said means comprising snap-connecting, removal-resistant means.

13. A tamper-evident dispensing package comprising a container, a dispensing closure secured to said container, and means for resisting removal of said closure from said container, said dispensing closure comprising a body secured to said container and a cover connected to said body, a dispensing orifice defined by said body and means on said cover for sealing said orifice, tamper-indicating means formed with said dispensing closure for making evident that access has been gained to said dispensing orifice, said tamper-indicating means comprising a removable strip integrally formed with the closure and connected via frangible bridging means integrally formed with one of said body and cover, said removable strip defining recess means, and projection means formed with the other of said body and cover, and said projection means extending into said recess means, whereby when said cover is moved from said closed position towards an open position, said projection means bear against said removable strip and the cover may not readily be moved from said closed position without first severing at least a portion of said frangible bridging means.

14. A tamper-evident dispensing package in accordance with claim 13 wherein said frangible bridging means comprises a plurality of frangible bridges connected to said closure body, said recess means are at least two in number, and said projection means are at least two in number, and wherein said closure cover may not be readily moved from said closed position without first severing at least one of said bridges.

15. A tamper-evident dispensing package in accordance with claim 13 wherein said tamper-indicating means and said removable strip are disposed within the perimeter of the closure and have no protuberance extending outwardly of the perimeter of the closure.

16. A tamper-evident dispensing package in accordance with claim 13 wherein said dispensing closure is generally circular and said projection means project in a direction outward of said cover and said recess means are each spaced apart at least about 30° from each other.

17. A tamper-evident dispensing package in accordance with claim 13 wherein said recess means are defined by said removable strip.

18. A tamper-evident dispensing package in accordance with claim 17 wherein said recess means are defined by said removable strip, by said frangible means and by one of said closure body and closure cover.

19. A tamper-evident dispensing package in accordance with claim 17 wherein said removable strip is connected to said closure body.

20. A tamper-evident dispensing package in accordance with claim 13 wherein said closure body and closure cover are hingedly connected by an over-center, snap-type hinge and said means for resisting removal of said closure from said container comprises snap-connecting means on said closure.

* * * * *